US007793726B2

(12) United States Patent
Daniel et al.

(10) Patent No.: US 7,793,726 B2
(45) Date of Patent: Sep. 14, 2010

(54) MARINE RISER SYSTEM

(75) Inventors: Jeremiah Daniel, Houston, TX (US); James E. Dailey, Spring, TX (US); Ruxin Song, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 11/567,649

(22) Filed: Dec. 6, 2006

(65) Prior Publication Data

US 2008/0138159 A1 Jun. 12, 2008

(51) Int. Cl.
*E21B 43/01* (2006.01)

(52) U.S. Cl. ..... 166/367; 166/366; 166/350; 166/352; 405/224.2; 405/224.3

(58) Field of Classification Search ..... 166/357, 166/366–369, 359, 350–352; 405/224.2–224.4
See application file for complete search history.

(56) References Cited

U.S. PATENT DOCUMENTS 3,602,302 A 8/1971 Kluth
3,855,656 A * 12/1974 Blenkarn ..... 441/22
3,874,415 A 4/1975 Pierce et al.
4,436,048 A 3/1984 Gentry et al.
4,448,568 A * 5/1984 Gentry et al. ..... 405/168.3
4,478,586 A * 10/1984 Gentry et al. ..... 441/4
4,502,551 A 3/1985 Rule et al.
4,523,602 A 6/1985 Snyder
4,765,378 A 8/1988 Engelskirchen et al.
5,041,038 A * 8/1991 Poldervaart et al. ..... 441/5
5,275,510 A * 1/1994 de Baan et al. ..... 405/171
5,335,730 A 8/1994 Cotham, III
5,456,622 A * 10/1995 Breivik et al. ..... 441/3
5,515,803 A * 5/1996 Korsgaard ..... 114/230.13
5,697,732 A 12/1997 Sigmundstad
5,878,814 A 3/1999 Breivik et al.
5,895,077 A 4/1999 Sigmundstad
5,983,931 A 11/1999 Ingebrigtsen et al.
6,003,603 A 12/1999 Breivik et al.
6,021,848 A 2/2000 Breivik et al.
6,050,747 A 4/2000 Midttveit (Continued)

*Primary Examiner*—Thomas A Beach
*Assistant Examiner*—Matthew R Buck
(74) *Attorney, Agent, or Firm*—Merchant & Gould

(57) ABSTRACT

A marine riser system for transferring fluid between a well on the seafloor and a vessel floating on the surface of the sea. The riser system has a turret buoy capable of connecting to a floating vessel; two or more hybrid risers, each of the hybrid risers having a vertical riser, a riser buoy attached to the upper portion of the vertical riser and a flexible jumper connecting the riser buoy to the turret buoy, and wherein the hybrid risers are secured to the seafloor. A flowline may connect a lower portion of each of the vertical risers to a subsea manifold, which interconnects the flowline and a subsea well. The subsea manifold is capable of controlling the flow to or from a subsea well. The hybrid risers are positioned about the turret buoy so that the turret buoy is horizontally balanced while disconnected from a vessel. In another embodiment, the marine riser system is capable of directing a fluid from the floating vessel to a subsea export flowline. In another embodiment, the present invention discloses a method of producing hydrocarbons from a subsea well, utilizing the marine riser system.

26 Claims, 4 Drawing Sheets

U.S. PATENT DOCUMENTS 6,053,787 A 4/2000 Erstad et al.
6,059,620 A 5/2000 Yetman
6,062,769 A * 5/2000 Cunningham ..... 405/195.1
6,082,391 A * 7/2000 Thiebaud et al. ..... 137/236.1
6,094,937 A 8/2000 Paurola et al.
6,193,574 B1 2/2001 Pollack
6,199,500 B1 * 3/2001 Børseth et al. ..... 114/230.12
6,220,787 B1 4/2001 Tanabe et al.
6,230,809 B1 5/2001 Korsgaard
6,257,801 B1 * 7/2001 Kelm et al. ..... 405/224.2
6,772,840 B2 * 8/2004 Headworth ..... 166/302
6,811,355 B2 * 11/2004 Poldervaart ..... 405/169
6,845,727 B2 1/2005 Eide et al.
6,926,084 B2 8/2005 Erstad
6,968,899 B1 11/2005 Poldervaart et al.
7,073,593 B2 * 7/2006 Hatton et al. ..... 166/367
7,093,661 B2 * 8/2006 Olsen ..... 166/357
7,434,624 B2 * 10/2008 Wilson ..... 166/368
2003/0056954 A1 * 3/2003 Headworth ..... 166/302
2003/0099517 A1 5/2003 Poldervaart
2003/0138299 A1 7/2003 Eide et al.
2004/0042856 A1 3/2004 Erstad
2004/0076478 A1 * 4/2004 Legras et al. ..... 405/224.2
2004/0144543 A1 * 7/2004 Appleford et al. ..... 166/336
2005/0145388 A1 * 7/2005 Hopper ..... 166/357
2006/0243328 A1 11/2006 Bessmertny
2007/0095427 A1 5/2007 Ehrhardt et al.
2007/0155259 A1 7/2007 Van Tol et al.
2008/0135256 A1 6/2008 Daniel
2008/0135258 A1 6/2008 Daniel
2008/0140337 A1 6/2008 Daniel
2009/0103985 A1 * 4/2009 Casola et al. ..... 405/170

* cited by examiner

MARINE RISER SYSTEM

TECHNICAL FIELD

This invention relates to a marine riser system for the production of hydrocarbons. In particular, it relates to a riser system that is capable of maintaining a buoy in a horizontally balanced position while the buoy is disconnected from a floating vessel, and a method and apparatus for connecting and disconnecting a floating vessel to the buoy.

BACKGROUND OF THE INVENTION

In the production of hydrocarbons from marine oil and gas deposits, a fluid communication system from the sea floor to the surface is required. Such a system usually includes multiple conduits through which various fluids flow between a subsea well or pipeline to a surface facility. The multiple conduits for communicating with a surface facility typically include subsea trees, manifolds, production and export flowlines, buoys and riser systems.

One method for producing hydrocarbons from marine oil fields is to use a fixed facility attached to the seafloor, however, known fixed facilities can be enormously expensive. A lower cost approach for producing from marine oil fields involves the use of floating facilities or floating vessels. Floating vessels present additional challenges as they can undergo a variety of movements in an offshore environment and are exposed to rapidly changing and unpredictable surface and sub-surface conditions. In particularly extreme weather conditions, it may be necessary for the floating vessel to disconnect from its associated production flowline and riser system. Further, the disconnected riser system must be storm-safe while disconnected from the floating vessel.

Connections between the riser system and the floating vessel can be direct or indirect. In deep water, direct connection of single or bundled risers to a floating facility is feasible but generates constraints: 1) the riser must be installed after the floating facility is on location, which is usually on the critical path for planning purposes; 2) disconnection takes a long time and is not feasible under adverse weather conditions; and 3) the motion of the floating facility imposes stress on the risers which can be detrimental in terms of riser fatigue. Other direct connection systems have been proposed to support risers such as cylindrical buoys with or without ballasting elements, and riser towers, which may not be economical for small to medium reserves fields with a small number of risers.

Indirect connection of single or bundled risers to a floating facility is a preferred approach. Common industry practice is to accommodate vessel rotation about a fixed riser system by means of a turret and swivel assembly, which may be internal or external to the floating vessel. Such marine riser systems typically terminate in a buoy, which is designed to interface with the floating vessel. While disconnected from the floating vessel, horizontal loads from the risers are typically unbalanced. Industry practice has been to use a buoy anchor line, tether or mooring (tag line) to maintain buoy response within a prescribed vertical envelope. In deepwater, tag lines, which are usually anchored to the seafloor, become very expensive as the length of the tagline can be in the order of 7,000 to 10,000 ft. or more.

The aim of the present invention is to provide an alternative form of riser system in which the above mentioned problems are overcome or in the very least alleviated.

The invention in its preferred embodiments provides a low cost marine riser system for the recovery of hydrocarbons from the seafloor to a floating vessel. The riser system terminates in a disconnectable buoy that can be rapidly connected and disconnected to a floating facility, in the event of unplanned weather conditions. Further the riser system is capable of providing sufficient balanced tension to the disconnectable buoy to maintain the disconnectable buoy within a prescribed horizontal and vertical envelope while the buoy is disconnected from a floating vessel, without the use of additional tag lines.

SUMMARY OF THE INVENTION

The present invention is directed to an improved marine riser system that is capable of maintaining a disconnectable buoy in a horizontally balanced position while the buoy is disconnected from a floating vessel. In one embodiment, the present invention is a marine riser system for transferring fluid between a well penetrating a subsurface formation beneath the seafloor and a vessel floating on the surface of the sea comprising a disconnectable buoy capable of connecting to a floating vessel; and a plurality of hybrid risers, each of the hybrid risers having a vertical riser, a riser buoy attached to an upper portion of the vertical riser and a flexible jumper interconnecting the riser buoy and the disconnectable buoy. Optionally, a flowline may be connected to a lower portion of the vertical riser for providing fluid communication between the hybrid riser and the subsea well. The hybrid risers are positioned about the disconnectable buoy so that the disconnectable buoy is horizontally balanced while disconnected from a floating vessel. Optionally, the disconnectable buoy may be connected to a floating vessel for producing hydrocarbons from the subsea well.

In another embodiment of the present invention, an export flowline is connected to a lower portion of one of the hybrid risers, to provide fluid communication between the floating vessel and the subsea export flowline when the disconnectable buoy is connected to the floating vessel.

Optionally, in some embodiments of the present invention, the disconnectable buoy may be a turret buoy. Further, the disconnectable buoy can include a positioning system transponder and can have a pressure protection and control device. In some embodiments, one or more of the hybrid risers may be secured to the seafloor.

In other embodiments of the present invention, a subsea manifold interconnecting a flowline and at least one subsea well is capable of controlling the flow to or from a subsea well. Optionally, the hybrid risers, flowline and subsea manifold can form a round-trip pigging loop.

In a particular embodiment, the marine riser system for transferring fluid between a well on the seafloor and a vessel floating on the surface of the sea comprises: a disconnectable turret buoy capable of connecting to a floating vessel; a plurality of hybrid risers, each of the hybrid risers comprising a vertical riser, a riser buoy attached to the upper portion of the vertical riser and a flexible jumper interconnecting the riser buoy to the disconnectable turret buoy, and wherein each of the hybrid risers is secured to the seafloor; a flowline connected to a lower portion of each of the vertical riser for providing fluid communication between the hybrid risers and a subsea well; and a subsea manifold interconnecting the flowline and a subsea well, the subsea manifold capable of controlling the flow to or from a subsea well. The hybrid risers are positioned so that the disconnectable turret buoy is horizontally balanced while disconnected from the floating vessel.

Optionally, the hybrid risers, flowline and subsea manifold can form a round-trip pigging loop, and a subsea export flowline may be connected to a lower portion of one of the vertical risers for directing a fluid from the floating vessel.

In another embodiment a marine riser system is provided for transferring fluid between a vessel floating on the surface of the sea and an export flowline. The riser system comprises: a disconnectable turret buoy capable of connecting to a floating vessel; a plurality of hybrid risers, each of the hybrid risers comprising a vertical riser, a riser buoy attached to the upper portion of the vertical riser and a flexible jumper interconnecting the riser buoy to the disconnectable turret buoy, and wherein the hybrid risers are secured to the seafloor; and a subsea export flowline connected to a lower portion of one of the vertical risers capable of directing a fluid from the floating vessel. In a further embodiment, a second export flowline can be connected to a lower portion of one of the vertical risers capable of directing a fluid from the floating vessel. The hybrid risers are positioned so that the disconnectable turret buoy is horizontally balanced while disconnected from the floating vessel.

The present invention is further directed to a method of producing hydrocarbons from a subsea well. The method comprises: locating a disconnectable buoy horizontally balanced between a plurality of hybrid risers, connecting a floating vessel to the disconnectable buoy, the floating vessel capable of receiving hydrocarbons produced from a subsea well; establishing fluid communication between a subsea well and the floating vessel through the hybrid risers and the disconnectable buoy; and adjusting the pressure in at least one of the hybrid risers.

Optionally, the method can include the steps of receiving hydrocarbons produced from a subsea well; exporting hydrocarbons produced from a subsea well to an export flowline; disconnecting the disconnectable buoy from the floating vessel; interrupting the fluid communication between a subsea well and the floating vessel prior to disconnecting; and adjusting the pressure in the hybrid risers prior to disconnecting the floating vessel from the disconnectable buoy. According to other embodiments of the present inventive method, the disconnectable buoy can comprise a turret buoy, a positioning system transponder, and a pressure protection and control device. In some embodiments, one or more of the hybrid risers may be secured to the seafloor.

Additional features and advantages of the present invention are described in, and will be apparent from, the following Detailed Description of the Invention, Detailed Description of the Drawings and the Figures.

BRIEF DESCRIPTION OF THE DRAWINGS

These and other objects, features and advantages of the present invention will become better understood with regard to the following description, pending claims and accompanying drawings where:

Figure 1A:
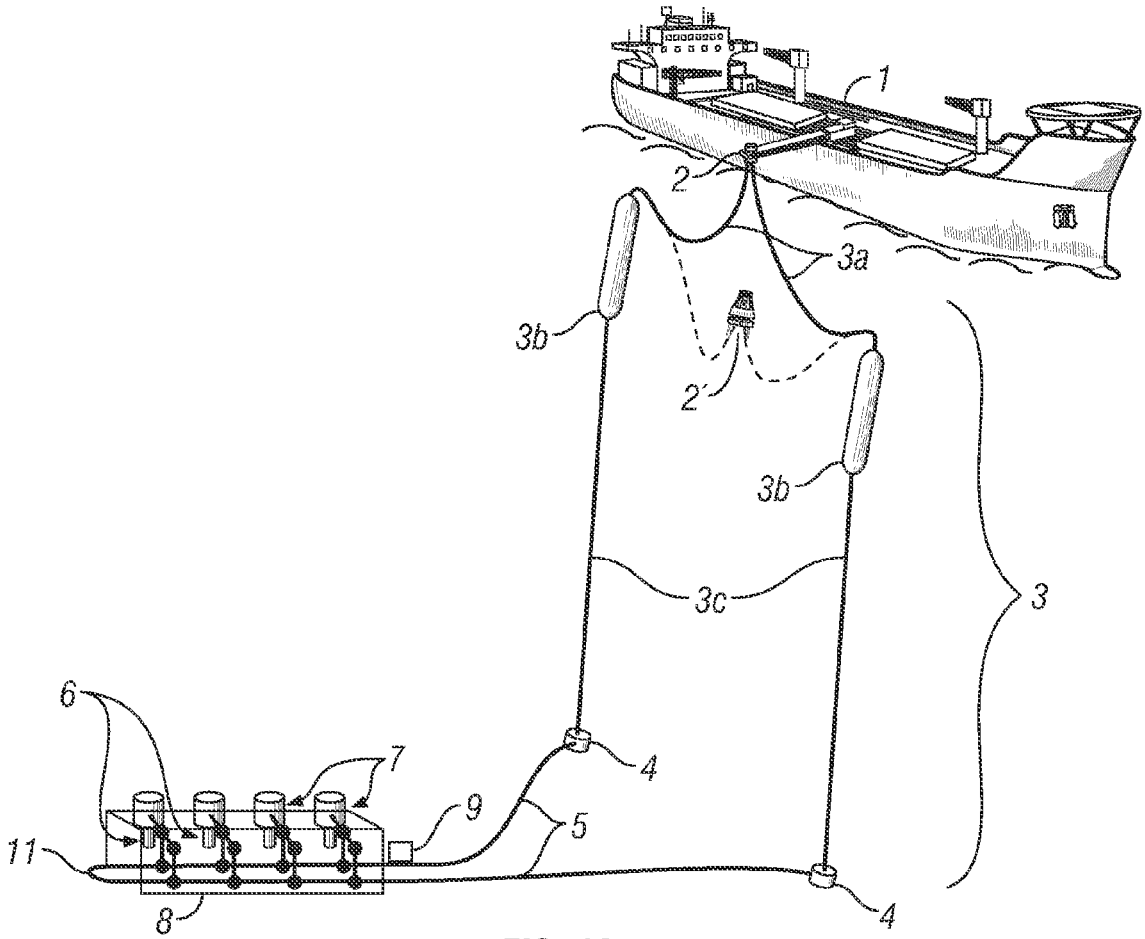
FIG. 1A is a schematic representation of an embodiment of the marine riser system described herein for transferring fluid between a well penetrating a subsurface formation beneath the seafloor and a vessel floating on the surface of the sea.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which are included within the spirit and scope of the invention, as defined by the appended claims.

DETAILED DESCRIPTION OF THE INVENTION

While this invention is susceptible of embodiments in many different forms, there are shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

Methods and systems that account for the interface between the floating vessels and a marine riser system have been described in the literature. However, no existing approach considers the idea, introduced here for the present invention, of using a riser system to maintain a buoy in a horizontally balanced position, without the use of additional tag lines, while the buoy is disconnected from a floating vessel, in order to prevent damage to the disconnectable buoy and the riser system.

The marine riser system of the present invention for transferring fluid between a well penetrating a subsurface formation beneath the seafloor and a vessel floating on the surface of the sea, comprises: a) a disconnectable buoy capable of connecting to a floating vessel; and b) a plurality of hybrid risers, each of the hybrid risers comprising a vertical riser, a riser buoy attached to an upper portion of the vertical riser and a flexible jumper interconnecting the riser buoy and the disconnectable buoy. Optionally a flowline may be connected to a lower portion of the vertical riser for providing fluid communication between the hybrid riser and a subsea well; wherein the hybrid risers are positioned about the disconnectable buoy so that the disconnectable buoy is horizontally balanced while disconnected from the floating vessel.

The vessel floating on the surface of the sea can be any floating facility that can receive, process, store or export produced hydrocarbons, and is capable of disconnecting from the riser system at the disconnectable buoy. Typical floating facilities or vessels that can be used include, but are not limited to: floating production storage and offloading (FPSO) vessels, barges, articulated tug barges, semi-submersible rigs, and ships. The connection and disconnection system controls and hardware will be located on the floating vessel with the corresponding equipment located on the disconnectable buoy. Such systems or methods include, but are not limited to turrets, wedges, clamps, and collet connectors.

The disconnectable buoy is the connection point between the marine hybrid risers and the floating vessel. The disconnectable buoy will incorporate the required buoyancy and ballast system to ensure the disconnectable buoy will float at a predetermined depth below the surface of the water when it is disconnected from the floating facility. Additionally the disconnectable buoy may incorporate a positioning system transponder to be used in locating the disconnectable buoy while disconnected from a floating facility. The buoy may incorporate a pressure protection and control device to be used in adjusting the pressure in one or more of the hybrid risers. The pressure protection and control device can include an assembly of sensors and valves that will enable the pressure in the hybrid risers to be reduced to a desired pressure. Where the disconnectable buoy is a turret buoy, the pressure protection and control device may be positioned within the buoy or within the turret system located on the floating vessel, provided the pressure protection and control device is upstream of the turret swivels, located on the floating vessel. An overpressure protection device suitable for use in the present invention, is further described in applicants' co-pending U.S. Patent Application to Jeremiah Daniel, et al., titled Overpressure Protection Device, Ser. No. 11/567,658, filed concurrently herewith on Dec. 6, 2006, which is incorporated by reference herein. A method for preventing overpressure suitable for use in the present invention, is further described in applicants' co-pending U.S. Patent Application to Jeremiah Daniel, et al., titled Method for Preventing Overpressure, Ser. No. 11/567,663, filed concurrently herewith on Dec. 6, 2006, which is incorporated by reference herein.

Figure 2A:
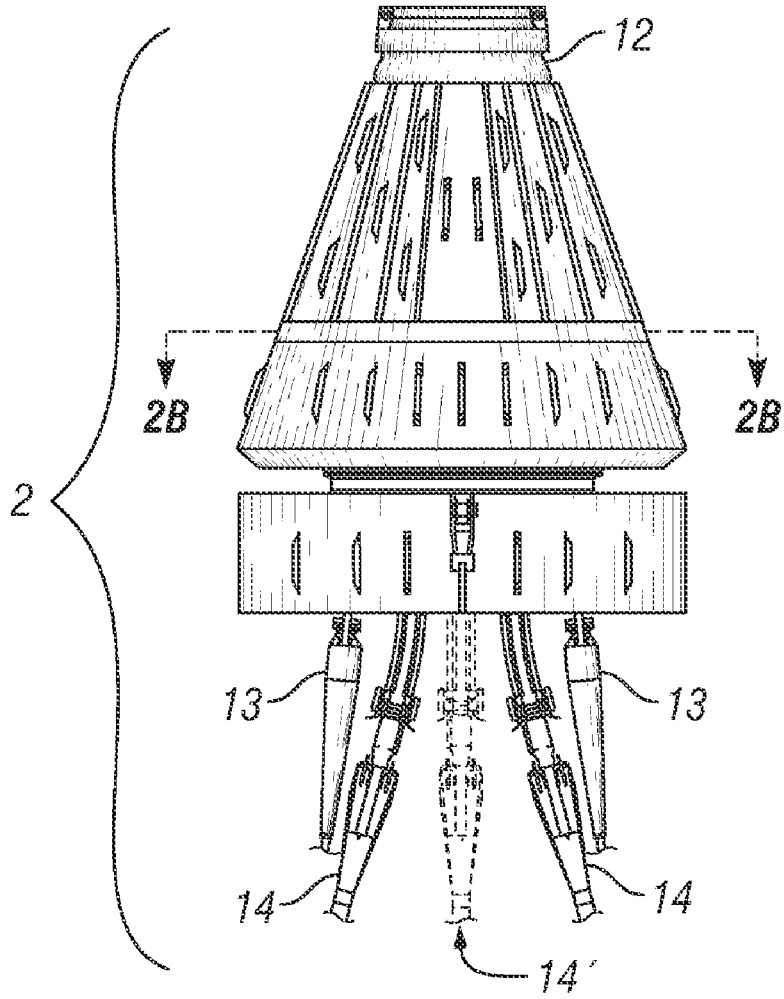
FIG. 2A is a side view of a turret buoy suitable for use in the present invention described herein.
Figure 2B:
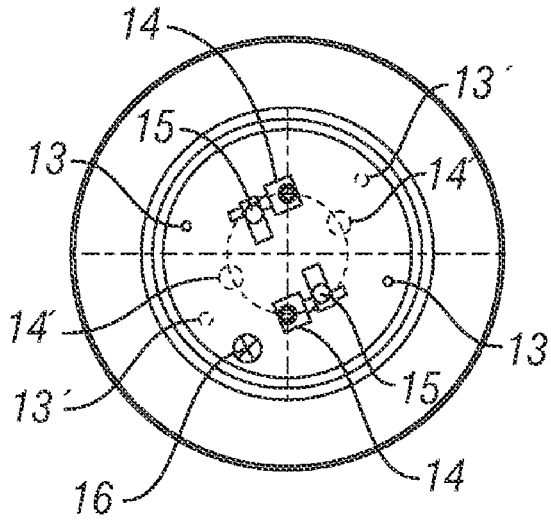
FIG. 2B is a horizontal cross-sectional view, taken through section line 2B-2B, of the turret buoy of FIG. 2A.

While a variety of riser termination buoys may be employed and are capable of housing connection and disconnection system controls and hardware for connecting to a floating vessel, FIGS. 2A and 2B illustrate the use of a turret buoy as the disconnectable buoy of the invention. There are a number of existing turret buoys and disconnectable turret systems suitable for use in the present invention, such as those manufactured by Advanced Production and Loading AS, FMC SOFEC, and Single Buoy Mooring Inc. Typical turret buoys have piping that extends through a vertical shaft within the buoy for connection to the floating facility at the top of the buoy and to the riser system at the bottom of the buoy. When the disconnectable buoy is a turret buoy, the hybrid risers are connected to the piping that extends below the buoy, with bolts or other conventional connecting means may be used. Actuators and valves are located near the top of the buoy for controlling flow and isolating the hybrid risers.

The marine riser system provides the means for fluid communication between the disconnectable buoy and at least one flowline on the sea floor, which is connected to at least one subsea well or export flowline. The risers may be steel catenary risers or flexible risers with single or multiple flowlines, depending on the characteristics of the production system. A feature of the present invention is the use of a plurality of hybrid risers. A plurality in this context is intended to refer to two or more hybrid risers. Each hybrid riser typically has at least three components: a vertical riser portion, a riser buoy, and a flexible jumper. A production flowline on the sea floor from a subsea well or an export flowline may curve vertically upward from the seafloor to a riser buoy, to provide the vertical riser portion of the hybrid riser. Alternatively, the production or export flowline can connect to a vertical riser portion, at or near the seafloor. The riser buoy is designed to keep the vertical riser portion under substantial tension, so the risers cannot move about and strike one another. At the riser buoy, the vertical riser portion is connected to one end of a flexible tubular jumper. The flexible jumper is then flexibly connected at its opposite end to the disconnectable buoy. A feature of the present invention is the ability of the flexible jumpers to keep the disconnectable buoy horizontally balanced between the hybrid risers, which are positioned in an array about the disconnectable buoy, while disconnected from the floating vessel.

At least two hybrid risers are preferably needed to balance the disconnectable buoy; however more may be desired depending upon the specific application. The hybrid risers are designed to provide sufficient balanced tension to the disconnectable buoy to maintain the buoy within a prescribed horizontal and vertical envelope while the buoy is disconnected from a floating vessel, without the need for additional tag lines. Optionally, one or more of the hybrid risers may be secured to the seafloor to provide additional support and stability to the hybrid risers. In a preferred embodiment, each of the hybrid risers is secured to the seafloor. Anchors suitable for this purpose are known, e.g., suction anchor systems or pile anchor systems.

The subsea manifold on the sea floor interconnects a flowline and at least one subsea well, and is capable of controlling flow to or from a subsea well or an associated subsea tree. A manifold is capable of accumulating and co-mingling the production from two or more subsea trees and their associated subsea wells, directing or redirecting production flow, and producing to the floating vessel through the flowlines and their associated hybrid risers. A manifold suitable for use in the present invention, is further described in applicants' co-pending U.S. Patent Application to Jeremiah Daniel, et al., titled Subsea Manifold, Ser. No. 11/567,637, filed concurrently herewith on Dec. 6, 2006, which is incorporated by reference herein.

The flowlines may be connected at the far end of the manifold by a pipe with the appropriate valving to form a round-trip pigging loop. The round-trip pigging loop formed by the hybrid risers, flowlines and manifold, will facilitate passing a pig from the floating vessel down through one of hybrid risers, flowlines, manifold and through the loop to the second flowline and hybrid riser to be returned to the floating vessel. In an alternative embodiment, wherein only one hybrid riser is providing fluid communication between a subsea well and a floating vessel, a pig sending and receiving unit may be used in place of the round-trip pigging loop.

A subsea tree, typically containing control valves, may be positioned on top of the subsea wellhead housing for providing means for controlling the production. The subsea tree may also have a choke, various monitors and flow measuring devices. The subsea tree has a production outlet, also known as a jumper or flowline jumper, which connects the subsea tree to subsea components, such as a manifold, that may be some distance away. The flowline jumpers between the various components on the sea floor are typically rigid steel pipes. An umbilical extends between the floating vessel and a control device or station located on the seafloor to operate the subsea components, including the subsea trees and manifold.

When the disconnectable buoy is connected to a floating vessel the described marine riser system provides means for producing hydrocarbons from a subsea well through the production flowlines and hybrid risers to the floating vessel. In another embodiment, produced fluids can be exported from the floating vessel through one or more hybrid risers that are connect to an export flowline and dedicated for exporting fluid from the floating vessel.

Another embodiment includes a method for producing hydrocarbons from a subsea well. The method comprises the steps of: a) locating a disconnectable buoy horizontally balanced between a plurality of hybrid risers, b) connecting a floating vessel to the disconnectable buoy, the floating vessel capable of receiving hydrocarbons produced from a subsea well; c) establishing fluid communication between a subsea well and the floating vessel through the hybrid risers and the disconnectable buoy; and d) adjusting the pressure in at least one of the hybrid risers.

When disconnected the disconnectable buoy is stowed at a depth of water which is below all seagoing traffic, normally below 30 meters under the surface of the sea. The floating vessel will locate the disconnectable buoy by means known in the art, such as a positioning system transponder or floatation marker on the surface of the sea. Where the disconnectable buoy is a turret buoy, the buoy is brought up and connected to a rotatable turret seat located on the floating vessel such that the vessel can freely weathervane about the buoy according to the wind and weather conditions. Fluid communication is established between the subsea wells and the floating vessel through the disconnectable buoy and turret system.

Adjusting the pressure in the hybrid risers prior to initiating the transfer of fluids, may be necessary, and can be accomplished utilizing the pressure protection and control device in the disconnectable buoy further described in applicants copending U.S. Patent Application cited above. Other means of pressure protection and control may also be used. When the well head pressure is elevated, greater than about 2,000 to 4,000 psig, or the water depth is such that the pressure of the produced fluids is greater than about 2,000 to 4,000 psig, it is desirable to adjust the pressure in the hybrid risers by reducing the pressure.

After the pressure has been adjusted, the transfer of fluids, such as petroleum products, from a subsea well through the production flowlines and hybrid risers to loading tanks onboard the floating vessel, is initiated. In another embodiment, produced fluids can be exported simultaneously from the floating vessel through a dedicated hybrid riser to a subsea export flowline.

In extreme weather conditions that cause intense vessel motions, it may be necessary for the floating vessel to disconnect from its associated production flowline and hybrid riser system. Ideally, prior to disconnecting the disconnectable buoy, the production is interrupted at the subsea tree and manifold, and the pressure in the hybrid risers is allowed to decrease or bleed prior to isolating the disconnectable buoy. Under emergency conditions fluids may be trapped at a high pressure as there may not be time to stop the production of fluids at the subsea tree and manifold or reduce the pressure, in which event the well is shut in at the disconnectable buoy prior to disconnection.

The systems described provide an alternative to known riser systems and are especially developed for deepwater and ultra-deepwater field developments, but may also be suitable for use in shallow water, particularly in areas where disconnection is a requirement because of sudden adverse meteorological and ocean conditions.

DETAILED DESCRIPTION OF THE DRAWINGS

The embodiment illustrated in FIG. 1A, shows a marine riser system for transferring fluid between a well penetrating a subsurface formation beneath the seafloor and a vessel floating on the surface of the sea. The riser system includes a disconnectable buoy 2 capable of connecting to a floating vessel 1. The disconnectable buoy 2 is connected to two hybrid risers 3. Each hybrid riser 3 has a flexible jumper 3*a*, a riser buoy 3*b*, and a vertical riser portion 3*c*, wherein the flexible jumper 3*a* is interconnecting the riser buoy 3*b* and the disconnectable buoy 2. When disconnected from the floating vessel, the disconnectable buoy is referenced as 2' in the disconnected position, is horizontally balanced between the hybrid risers 3 by the flexible jumpers 3*a* as indicated by the dashed lines. Each hybrid riser 3 is secured to the seafloor with anchor 4. A flowline 5 is connected to a lower portion 3*c* of each hybrid riser 3 and to subsea wells 6 through respective subsea trees 7, for providing fluid communication between the hybrid riser 3 and the subsea wells 6. A subsea manifold 8 interconnects the flowline 5 and subsea wells 6, for controlling flow to or from the subsea wells 6. The flowlines 5 are interconnected at or within manifold 8 by pipe 11 to form a round-trip pigging loop between the hybrid risers 3, flowlines 5 and manifold 8. When the disconnectable buoy is connected to the floating vessel 1 hydrocarbons may be produced from the subsea wells 6 to the floating vessel 1. A control device 9 receives umbilicals (not shown) from the floating vessel for providing control of the subsea trees 7 and manifold 8.

Figure 1B:
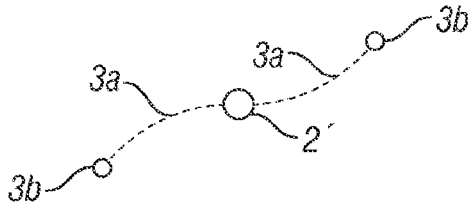
FIG. 1B is a top view of portions of a disconnectable buoy disconnected from a floating vessel in a horizontally balanced position between a plurality of two hybrid risers.

In the embodiment illustrated in FIG. 1B, a plurality of two hybrid risers is used to hold a disconnected buoy in a horizontally balanced position. Specifically, FIG. 1B shows a top view of a disconnectable buoy 2' disconnected from a floating vessel and being held in a horizontally balanced position between the hybrid risers 3*b*. Disconnectable buoy 2' is horizontally balanced between the hybrid riser buoys 3*b* by flexible jumpers 3*a* as indicated by the dashed lines.

Figure 1C:
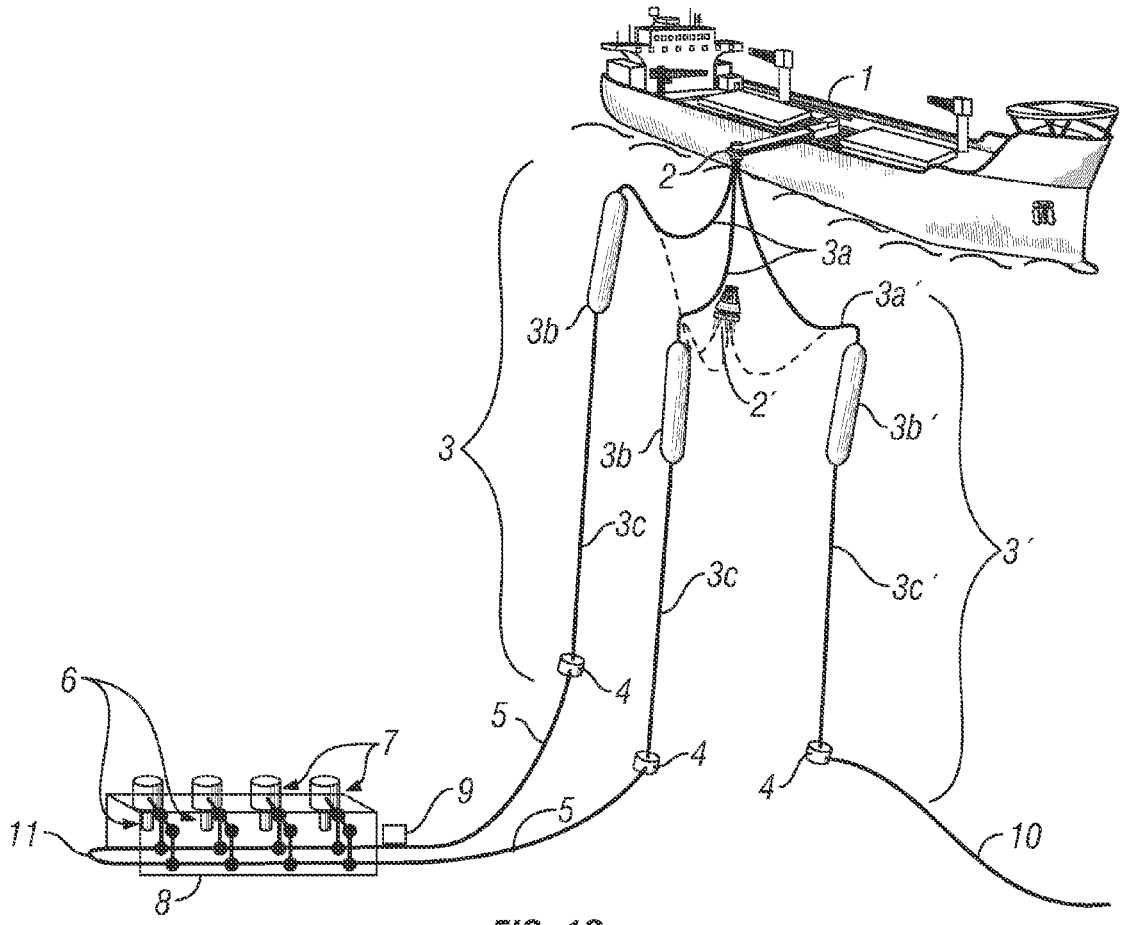
FIG. 1C is a schematic representation of an embodiment of the marine riser system described herein for transferring fluid between a well on the seafloor and a vessel floating on the surface of the sea, and further illustrating the transfer of fluid between the floating vessel and an export flowline.

The embodiment illustrated in FIG. 1C, shows a marine riser system similar to the marine riser system illustrated in FIG. 1A with the exception of a third hybrid riser 3' dedicated to an export flowline 10, capable of exporting a fluid from the floating vessel 1. The hybrid riser 3' has a flexible jumper 3*a*', a riser buoy 3*b*', and a vertical riser portion 3*c*'. When disconnected from the floating vessel, the disconnectable buoy 2' is horizontally balanced between the hybrid risers 3 and 3' by the flexible jumpers 3*a* and 3*a*' as indicated by the dashed lines. Each hybrid riser 3 and 3' is secured to the seafloor with anchor 4.

Figure 1D:
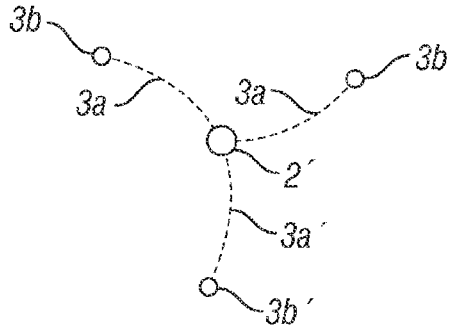
FIG. 1D is a top view of portions of a disconnectable buoy disconnected from a floating vessel in a horizontally balanced position between a plurality of three hybrid risers.

In the embodiment illustrated in FIG. 1D, a plurality of three hybrid risers is used to hold a disconnected buoy in a horizontally balanced position. Specifically, FIG. 1D shows a top view of a disconnectable buoy 2' disconnected from a floating vessel being held in a horizontally balanced position between the hybrid risers 3*b* and 3*b*'. Disconnectable buoy 2' is horizontally balanced between the hybrid riser buoys 3*b* and 3*b*' by flexible jumpers 3*a* and 3*a*' as indicated by the dashed lines.

FIG. 2A shows an example of a turret buoy suitable for use as the disconnectable buoy in the present invention described herein. Referring to FIG. 2A, the turret buoy 2 includes a collar 12 for connecting and disconnecting from a floating vessel. Umbilicals 13 are connected to the turret buoy for providing control from the floating vessel to a subsea control device. Hybrid risers 14 are connected to the turret buoy and additional risers 14' can be connected as indicated in dashed lines.

FIG. 2B shows a horizontal cross section of the disconnectable buoy 2 illustrated in FIG. 2A. Contained within the turret buoy 2, are umbilicals 13, and hybrid risers 14. Additional umbilicals 13' and addition hybrid risers 14' may be added as indicated by dashed lines. The turret buoy may, as illustrated, include a pressure protection and control device 15, and may include a positioning system transponder 16.

Figure 3A:
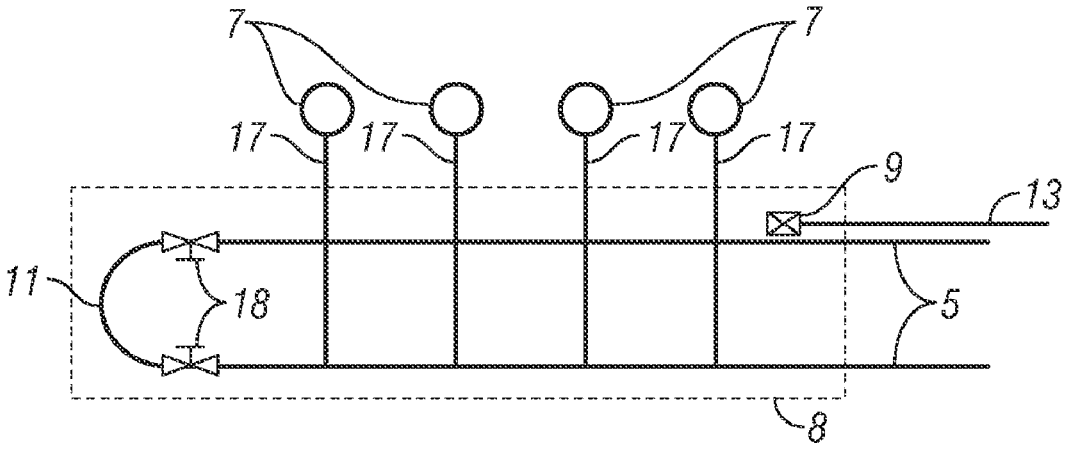
FIG. 3A is a top view schematic representation of a subsea manifold suitable for use in the present invention described herein.

FIG. 3A is a top view of a subsea manifold suitable for use in the present invention described herein. The outer boundary of subsea manifold 8 is indicated by a dashed line. The subsea trees 7 are in fluid communication with the manifold 8 through jumpers 17. The subsea manifold 8 interconnects the flowlines 5 and subsea trees 7, for controlling flows to or from the subsea wells. The flowlines 5 are interconnected within manifold 8 by pipe 11 to form a round-trip pigging loop between the hybrid risers, flowlines and manifold. Valves 18 are included to control the flow in manifold 8. The umbilicals 13 connect the floating vessel to the control device 9 to provide means for controlling the manifold 8 and subsea trees 7.

Figure 3B:
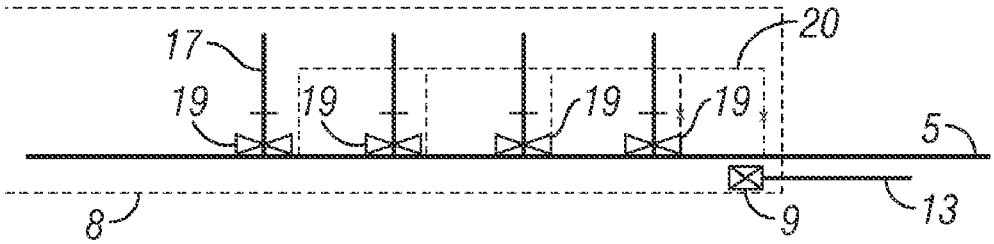
FIG. 3B is a side view schematic representation of the manifold of FIG. 3A.

FIG. 3B is a side view of the components of FIG. 3A. Referring to FIG. 3B, the subsea manifold 8 can isolate at least one well through a valve arrangement 19. The subsea manifold 8 includes jumpers 17 for interconnecting the flowlines 5 and subsea trees 7, for controlling the flow to or from the subsea wells. The control device 9, controls the position of valves 19 as indicated by dashed line 20.

Figure 3C:
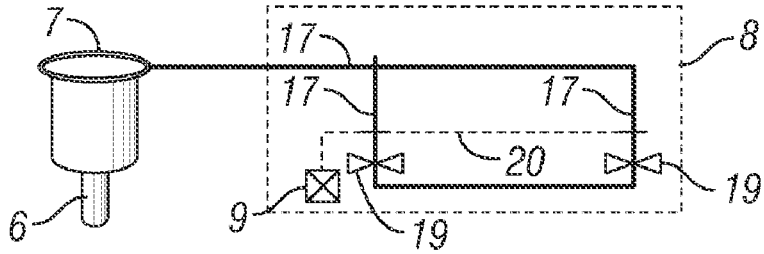
FIG. 3C is an end view schematic representation of the manifold of FIG. 3A.

FIG. 3C is an end view of the components of FIG. 3A. Referring to FIG. 3C, the subsea wells 6 is in fluid communication with the manifold 8 through a subsea tree 7 and associated jumper 17. Valves 19 control flow to or from subsea well 6.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What we claim is:

1. A marine riser system for transferring fluid between a subsea well penetrating a subsurface formation beneath the seafloor and a vessel floating on the surface of the sea, the riser system comprising:

a) a disconnectable buoy capable of connecting to a floating vessel;

b) a plurality of hybrid risers, each of the hybrid risers comprising a vertical riser, a riser buoy attached to an upper portion of the vertical riser and a flexible jumper interconnecting the riser buoy and the disconnectable buoy; and c) an anchor that secures each of the hybrid risers to the seafloor such that the vertical riser is substantially vertical;

wherein the hybrid risers are positioned about the disconnectable buoy so that the disconnectable buoy is horizontally balanced between the riser buoys within a balancing plane defined by the height of the riser buoys while disconnected from the floating vessel.

2. The marine riser system of claim 1 further comprising:

a flowline connected to a lower portion of the vertical riser for providing fluid communication between the hybrid riser and the subsea well.

3. The marine riser system of claim 2 wherein:

the disconnectable buoy is connected to the floating vessel for producing hydrocarbons from the subsea well.

4. The marine riser system of claim 1 further comprising:

an export flowline connected to a lower portion of one of the vertical risers capable of directing a fluid from the floating vessel.

5. The marine riser system of claim 1 wherein:

the disconnectable buoy comprises a turret buoy.

6. The marine riser system of claim 1 wherein:

the disconnectable buoy includes a positioning system transponder.

7. The marine riser system of claim 1 wherein:

the disconnectable buoy includes a pressure protection and control device.

8. The marine riser system of claim 2 further comprising:

a subsea manifold interconnecting the flowline and the subsea well capable of controlling the flow to or from the subsea well.

9. The marine riser system of claim 8 wherein:

the hybrid risers, flowline and subsea manifold form a round-trip pigging loop.

10. A marine riser system for transferring fluid between a subsea well penetrating a subsurface formation beneath the seafloor and a vessel floating on the surface of the sea, the riser system comprising:

a) a disconnectable turret buoy capable of connecting to a floating vessel;

b) a plurality of hybrid risers, each of the hybrid risers comprising a vertical riser, a riser buoy attached to the upper portion of the vertical riser and a flexible jumper interconnecting the riser buoy to the disconnectable turret buoy, wherein each of the hybrid risers is secured to the seafloor;

c) a flowline connected to a lower portion of each of the vertical riser for providing fluid communication between the hybrid risers and the subsea well; and d) a subsea manifold interconnecting the flowline and the subsea well, the subsea manifold capable of controlling the flow to or from the subsea well;

wherein the hybrid risers are positioned so that the disconnectable turret buoy is horizontally balanced between the riser buoys within a balancing plane defined by the height of the riser buoys while disconnected from the floating vessel.

11. The marine riser system of claim 10, wherein:

the hybrid risers, flowline and subsea manifold form a round-trip pigging loop.

12. The marine riser system of claim 10, further comprising:

an export flowline connected to a lower portion of one of the vertical risers for providing fluid communication between the floating vessel and the export flowline.

13. A marine riser system for transferring fluid between a vessel floating on the surface of the sea and an export flowline, the riser system comprising:

a) a disconnectable turret buoy capable of connecting to a floating vessel;

b) a plurality of hybrid risers, each of the hybrid risers comprising a vertical riser, a riser buoy attached to the upper portion of the vertical riser and a flexible jumper interconnecting the riser buoy to the disconnectable turret buoy, wherein the hybrid risers are secured to the sea; and c) an export flowline connected to a lower portion of one of the vertical risers capable of directing a fluid from the floating vessel;

wherein the hybrid risers are positioned so that the disconnectable turret buoy is horizontally balanced between the riser buoys within a balancing plane defined by the height of the riser buoys while disconnected from the floating vessel.

14. The marine riser system of claim 13, further comprising:

a second export flowline capable of directing a second fluid from the floating vessel.

15. A method of producing hydrocarbons from a subsea well, the method comprising:

a) locating a disconnectable buoy horizontally balanced within a balancing plane between a plurality of hybrid risers, wherein the hybrid risers are supported by riser buoys and the height of the riser buoys defines the balancing plane;

b) connecting a floating vessel to the disconnectable buoy, the floating vessel capable of receiving hydrocarbons produced from the subsea well;

c) establishing fluid communication between the subsea well and the floating vessel through the hybrid risers and the disconnectable buoy;

d) receiving hydrocarbons produced from the subsea well; and e) exporting hydrocarbons produced from the subsea well to an export flowline.

16. The method of claim 15 further comprising:

adjusting the pressure in at least one of the hybrid risers, when the pressure of the produced hydrocarbons is greater than about 2,000 psig.

17. The method of claim 15 further comprising:

disconnecting the disconnectable buoy from the floating vessel.

18. The method of claim 17 further comprising:

interrupting the fluid communication between the subsea well and the floating vessel prior to disconnecting the floating vessel from the disconnectable buoy.

19. The method of claim 17 further comprising:

adjusting the pressure in the hybrid risers prior to disconnecting the floating vessel from the disconnectable buoy.

20. The method of claim 15 wherein:

the disconnectable buoy comprises a turret buoy.

21. The method of claim 15 wherein:

the disconnectable buoy is located using a positioning system transponder.

22. The method of claim 15 wherein:

The pressure in the plurality of hybrid risers is adjusted using a pressure protection and control device in the disconnectable buoy.

23. The method of claim 15 wherein:

the hybrid risers provide sufficient balanced tension to the disconnectable buoy to maintain the buoy within a prescribed horizontal and vertical envelope while the buoy is disconnected from the floating vessel.

24. A marine riser system for transferring fluid between a subsea well penetrating a subsurface formation beneath the seafloor and a vessel floating on the surface of the sea, the riser system comprising:

a) a disconnectable buoy capable of connecting to a floating vessel;

b) a plurality of hybrid risers, each of the hybrid risers comprising a vertical riser, a riser buoy attached to an upper portion of the vertical riser and a flexible jumper interconnecting the riser buoy and the disconnectable buoy; and c) an anchor that secures each of the hybrid riser to the seafloor such that the vertical riser is substantially vertical;

wherein the hybrid risers are supported by said riser buoys without aid of the disconnectable buoy and the hybrid risers are positioned about the disconnectable buoy so that the disconnectable buoy is horizontally balanced between the riser buoys while disconnected from the floating vessel.

25. The marine riser system of claim 24 wherein:

the disconnectable buoy comprises a turret buoy.

26. The marine riser system of claim 24 wherein:

the disconnectable buoy includes a positioning system transponder.

* * * * *

UNITED STATES PATENT AND TRADEMARK OFFICE

CERTIFICATE OF CORRECTION

PATENT NO. : 7,793,726 B2
APPLICATION NO. : 11/567649
DATED : September 14, 2010
INVENTOR(S) : Jeremiah Daniel et al.

It is certified that error appears in the above-identified patent and that said Letters Patent is hereby corrected as shown below:

Title Page

Item (73) Assignee: "Chevron U.S.A. Inc., San Ramon, CA (US)"
should read --Chevron U.S.A. Inc., San Ramon, CA (US);
and Technip USA, Inc., Houston, TX (US)--

Signed and Sealed this
Fourth Day of January, 2011

David J. Kappos

David J. Kappos
*Director of the United States Patent and Trademark Office*